US012617495B2

(12) United States Patent
Hawkes et al.

(10) Patent No.: US 12,617,495 B2
(45) Date of Patent: May 5, 2026

(54) MARINE CLEAT WITH FASTENER RETENTION

(71) Applicant: Patrick Industries, Inc., Elkhart, IN (US)

(72) Inventors: Jed Hawkes, Everett, WA (US); Paul Masato Furrer, Everett, WA (US); Paul Olliges, Everett, WA (US)

(73) Assignee: Patrick Industries, Inc., Elkhart, IN (US)

( * ) Notice: Subject to any disclaimer, the term of this patent is extended or adjusted under 35 U.S.C. 154(b) by 448 days.

(21) Appl. No.: 18/454,738

(22) Filed: Aug. 23, 2023

(65) Prior Publication Data

US 2025/0065987 A1 Feb. 27, 2025

(51) Int. Cl.
*B63B 21/04* (2006.01)

(52) U.S. Cl.
CPC ..... *B63B 21/045* (2013.01)

(58) Field of Classification Search
CPC ..... B63B 21/04; B63B 21/045; B63B 21/06; B63B 21/08
USPC ..... 114/218
See application file for complete search history.

(56) References Cited

U.S. PATENT DOCUMENTS

2005/0252436 A1* 11/2005 King ..... B63B 21/04 114/218

* cited by examiner

*Primary Examiner* — Magdalena Topolski
*Assistant Examiner* — Shanna Danielle Glover
(74) *Attorney, Agent, or Firm* — Christensen O'Connor Johnson Kindness PLLC

(57) ABSTRACT

A marine cleat with fastener retention is provided. The marine cleat can be a folding cleat and can include a cleat body configured to operably couple to a mounting surface of the watercraft, and a cleat head extending away from the cleat body. The cleat head can have first and second projections configured to receive a portion of a line, e.g., for mooring the watercraft. A bottom side of the cleat body can include first and second fastener retention slots, each having an insertion cavity that is configured to receive a head of a fastener therein, and a retention end that is configured to laterally receive the head of the fastener and fix the fastener in both axial translation and axial rotation with respect to the cleat body. The insertion cavities of the first and second fastener retention slots can be positioned outwardly from the retention ends.

20 Claims, 9 Drawing Sheets

MARINE CLEAT WITH FASTENER RETENTION

BACKGROUND

A marine cleat is an accessory typically used on watercraft to provide a point to tie-down mooring, rigging, anchor, fender, and other lines to the watercraft. For example, when mooring the watercraft, a line is tied from a structure, such as a dock, other boat, pilon, etc., to the marine cleat on the watercraft to secure the watercraft to the structure. Cleats can also be used for leverage during watercraft maneuvers, such as with spring lines, or when a user partially wraps the line around the cleat to pull the line in or pay the line out in a controlled manner.

A cleat typically includes two projections parallel to the mounting surface and arranged such that a cleat hitch (a knot that secures the line portion but can be readily undone) can be tied around the projections, or such that the line can be wrapped around either of the projections during use of the cleat as leverage. The portion of the cleat with the projections (e.g., the cleat head) can be fixed or foldable. A fixed cleat does not include any moving parts, while a foldable cleat (or "folding cleat") allows the projections to be stowed when not in use for a flush and sleek folded position. Fixed cleats can be preferable in high strength applications, or in situations where the projections of the cleat need to be accessible at all times. In other applications, folding cleats can be preferable, such as with cleats mounted near walkways, cleats on smaller watercraft, and/or cleats on modern watercraft, where a sleeker look is preferred.

The marine cleat can be mounted to the deck, hull, or other structure of the watercraft where lines are tied down. Typically, the marine cleat includes holes for fasteners to pass through and be secured to the mounting surface. For example, the cleat can have two to four holes where bolts pass through and into complementary holes in the watercraft. These bolts are typically secured with nuts or other fastening features on the other end (e.g., under the hull surface, under the deck surface, etc.). This type of arrangement makes the fastener heads visible from the upper surface of the cleat. In folding cleats, these fastener heads are either visible with the cleat in a closed, stowed position, or the heads are positioned under the folding portion of the cleat such that they are only visible when the cleat is in the open, deployed position. In most of these configurations, the head of the fastener must be held stationary while the nut or other fastening feature is tightened. This installation limitation can make some installations more labor intensive (e.g., by requiring multiple installation personnel). Embodiments of a marine cleat in accordance with aspects of the present disclosure provide improved installation, aesthetic, and performance as compared to known marine cleats.

DESCRIPTION OF THE DRAWINGS

The foregoing aspects and many of the attendant advantages of the claimed subject matter will become more readily appreciated as the same become better understood by reference to the following detailed description, when taken in conjunction with the accompanying drawings, wherein:

DETAILED DESCRIPTION

Figure 1A:
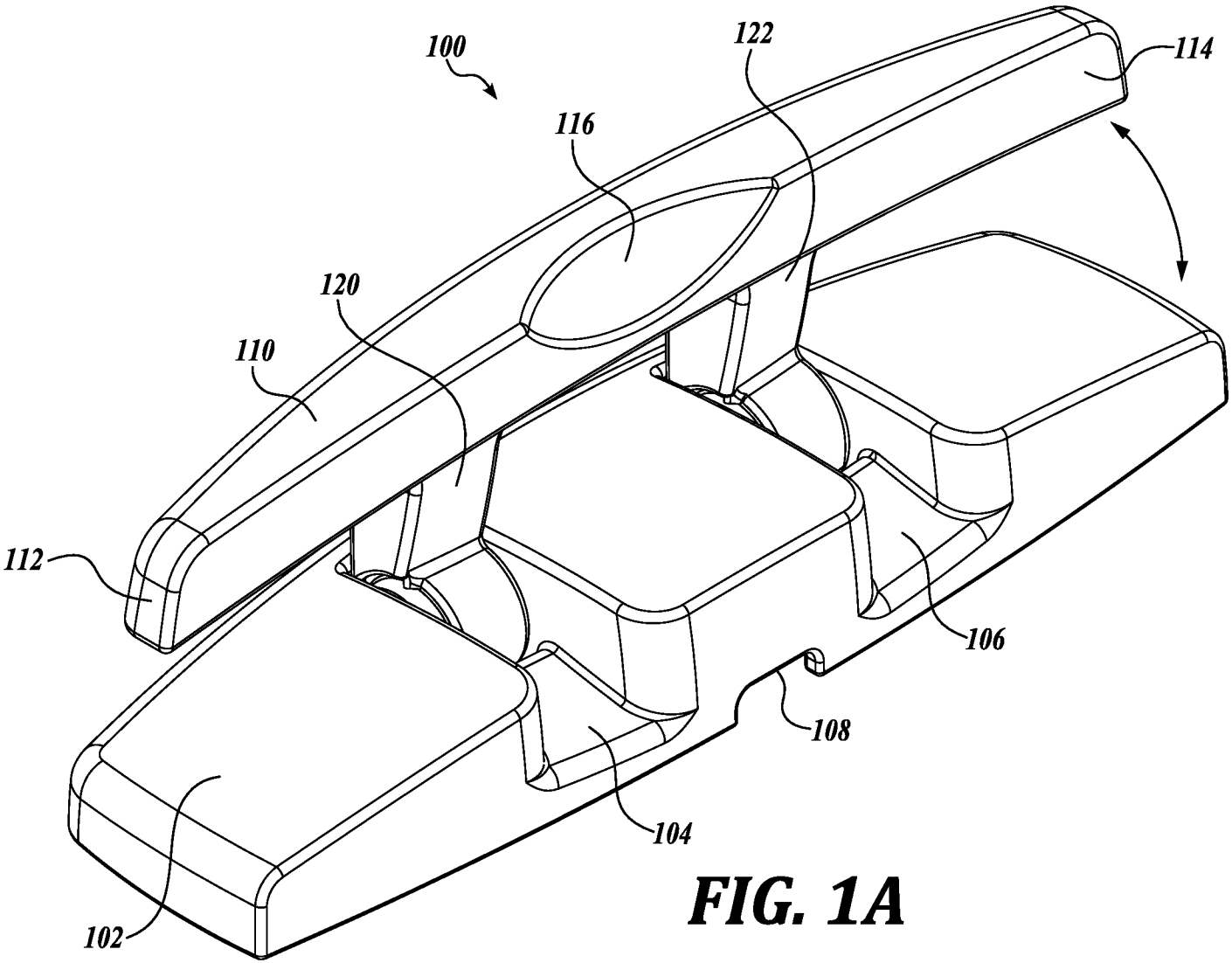
FIG. 1A is a top perspective view of one example of a marine cleat shown in a deployed position, in which technologies and/or methodologies of the present disclosure may be employed.

The detailed description set forth above in connection with the appended drawings, where like numerals reference like elements, are intended as a description of various embodiments of the present disclosure and are not intended to represent the only embodiments. Each embodiment described in this disclosure is provided merely as an example or illustration and should not be construed as preferred or advantageous over other embodiments. The illustrative examples provided herein are not intended to be exhaustive or to limit the disclosure to the precise forms disclosed.

As will be described in more detail below, the present disclosure provides examples of a marine cleat having fastener retention features that are expected to aid in installation of the marine cleat to the watercraft and to improve the aesthetic appearance of the cleat by concealing the fasteners once installed. Although the illustrated embodiments show a folding marine cleat having a portion capable of transitioning between deployed and stowed positions, the embodiments of the present disclosure are also applicable to fixed cleats and other watercraft accessories where concealed fasteners are desired.

The fasteners of the marine cleat can be concealed using fastener retention slots on the bottom of the cleat body. These fastener retention slots can be arranged in opposing directions such that when the marine cleat is placed on the installation structure (e.g., a surface with corresponding mounting holes) the cleat can not be moved laterally or longitudinally along the surface. The fastener retention slots can be configured with features that orient the fastener as the fastener is translated into the retention slot and to a seated position at a retaining end that substantially fixes the fastener in all degrees of freedom (rotation, translation, etc.) except in the direction of radial translation toward an insertion cavity (relative to the fastener) to remove the fastener from the slot. In the seated position, the fastener is secured against rotation such that a nut can be installed and torqued from the underside of the mounting surface without needing to hold the fastener head with a tool. In this regard, the marine cleat of the present disclosure can be typically installed by a single installation personnel, even in situations where both sides of the surface are not simultaneously accessible.

Although embodiments of the present disclosure may be described with reference to marine cleats for watercraft, one skilled in the relevant art will appreciate that the disclosed embodiments are illustrative in nature and therefore should not be construed as limited to such an application. It should therefore be apparent that the disclosed technologies and methodologies have wide application, and therefore may be suitable for use with many types of cleat architectures, including floating platforms, docks, barges, personal watercraft, and the like. Accordingly, the following descriptions and illustrations herein should not limit the scope of the claimed subject matter.

Figure 1B:
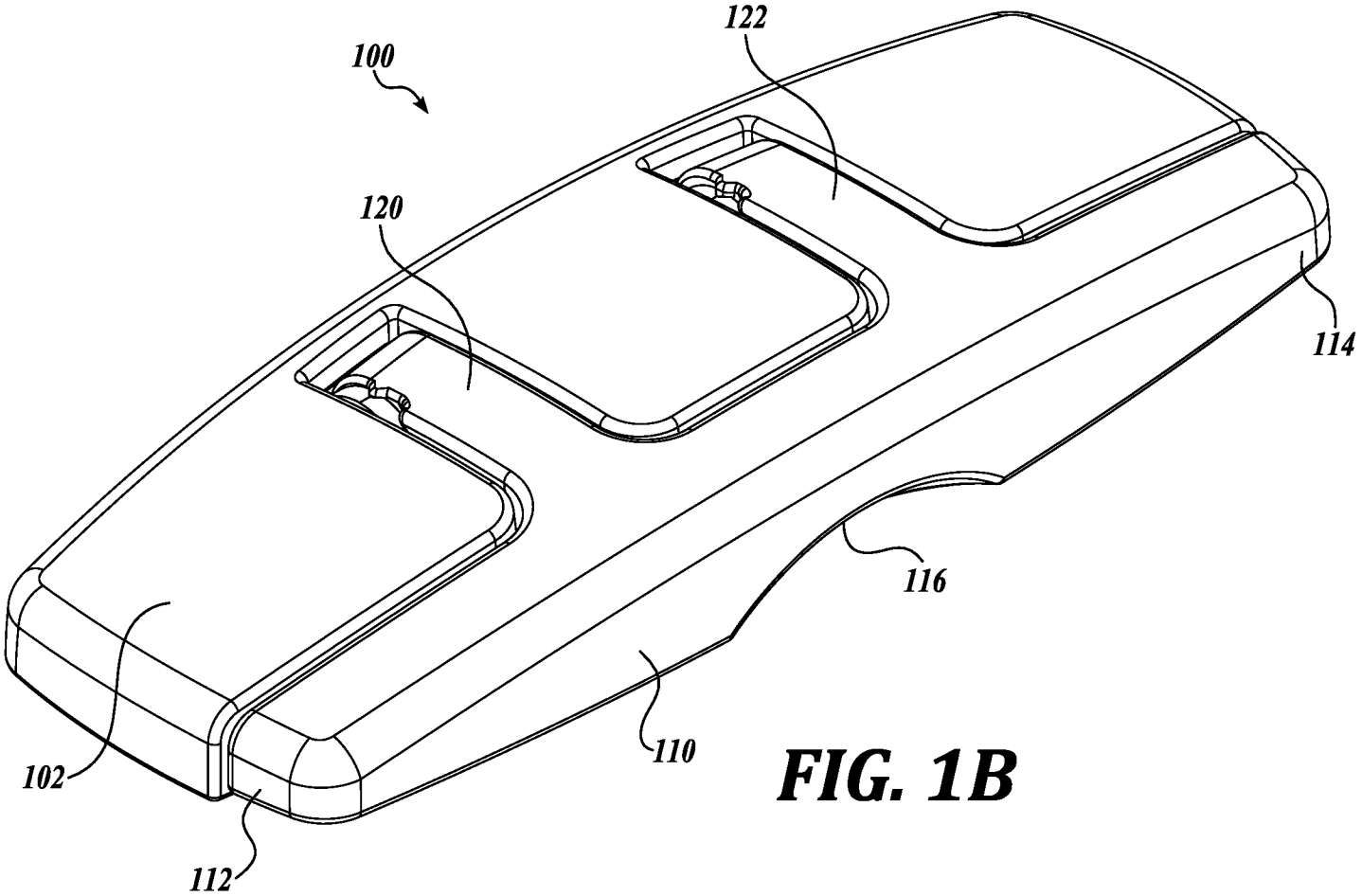
FIG. 1B is a top perspective view of the marine cleat of FIG. 1A, with the marine cleat shown in a stowed position.

FIGS. 1A and 1B are top perspective views of one example of a marine cleat 100 ("cleat 100"), with a cleat head 110 that is foldable and shown in a deployed position in FIG. 1A and a stowed position in FIG. 1B, in which technologies and/or methodologies of the present disclosure may be employed. The cleat 100 can include a cleat body 102 having a first clearance trough 104, a second clearance trough 106, and a drain opening 108 configured to permit water to flow away from the space between the cleat 100 and the mounting surface. The cleat body 102 can be elongated, as shown. As shown in the transition from FIG. 1A to 1B, the first and second clearance troughs 104 and 106 are configured to receive first and second legs 120 and 122 of the cleat head 110 to permit a flush surface configuration when the cleat 100 is in the stowed position of FIG. 1B.

The cleat head 110 includes a first projection 112, a second projection 114 extending away from the first projection 112, an opening relief 116, a first leg 120, and a second leg 122. The first and second projections 112 and 114 can extend longitudinally in opposite directions and substantially parallel to a mounting surface, and are configured to receive a cleat hitch knot of a line (not shown) to tie down the watercraft to a structure, e.g., while mooring. The first and second legs 120 and 122 permit the first and second projections 112 and 114 to be positioned away from the cleat body 102 such that the line can be wrapped under the first and second projections 112 and 114 with portions of the cleat hitch knot. The opening relief 116 is intended to provide a surface that the user can grip with a finger, thumb, or other object to assist in deploying the cleat head 110 from the stowed position. In other embodiments, the opening relief 116 can be any suitable shape, size, position, and/or quantity, or may project away from the cleat head 110 to permit the user to grasp the cleat head 110 to transition from the stowed position to the deployed position. Although one example of a folding configuration of the cleat head 110 is shown, other configurations arranged to receive a knot or otherwise secure the line are also within the scope of the present disclosure, such as pop-up cleat heads, curved cleat heads, friction cleat heads, etc.

Figure 2:
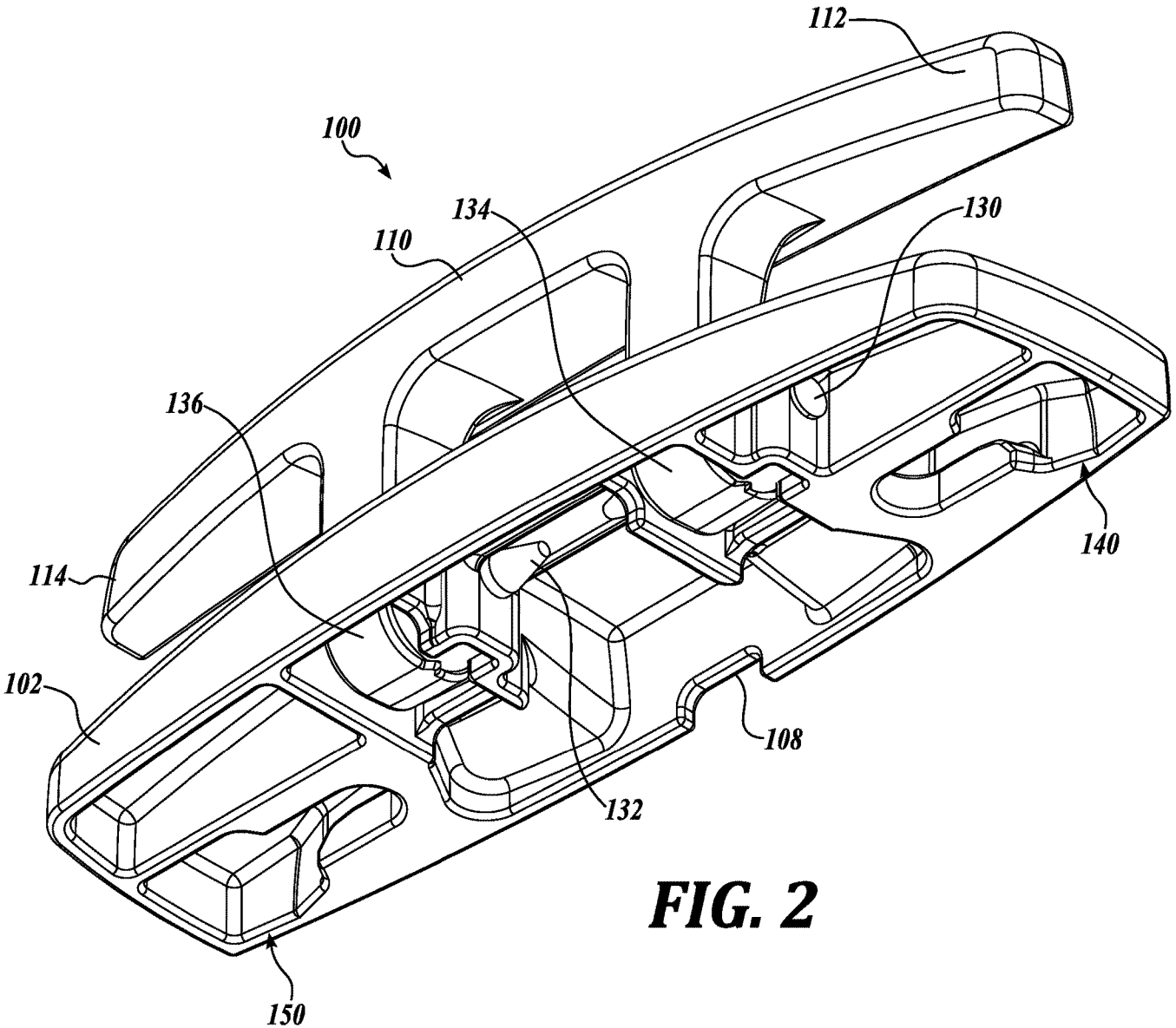
FIGS. 2-5 are bottom perspective, front, side, and bottom views, respectively, of the marine cleat of FIG. 1A.

FIGS. 2-5 are bottom perspective, front, side, and bottom views, respectively, of the cleat 100. As shown in FIG. 2, the first and second legs 120 and 122 extend into and are pivotable with respect to the cleat body 102. In this regard, the first leg 120 has a first pivot end 134 that is pivotable about a first pin 130, and the second leg 122 has a second pivot end 136 that is pivotable about a second pin 132. The first and second pins 130 and 132 provide a rotation axis about which the cleat head 110 rotates to transition between the stowed and deployed positions.

In use, it can be desirable to releasably retain the cleat head 110 in either the stowed position or the deployed position until a user applies a minimum force to transition the cleat head 110 away from its current position. For example, when the cleat head 110 is not in use and is in the stowed position, movement of the watercraft would generally cause the cleat head 110 to vibrate or move, causing wear and noise. Similarly, if the cleat head 110 is in the deployed position, the cleat head 110 may rotate to the stowed position unintentionally. One or more features can be configured to resist such unintentional movement, such as a detent having mechanical keyed features shown most clearly in FIG. 5. The first pivot end 134 can include a key detent protrusion 135*a* that is configured to be received within a key detent slot 135*b*. Similarly, the second pivot end 136 can include a key detent protrusion 137*a* that is configured to be received within a key detent slot 137*b*. Although only a single key detent protrusion and slot pair are shown for each of the pivot ends, any number of key detent protrusion and slot pairs can be used with each of the pivot ends, such as two, three, four, etc. Other features to prevent unintentional movement, such as friction, magnetic features, etc. are also within the scope of the present disclosure.

Figure 5:
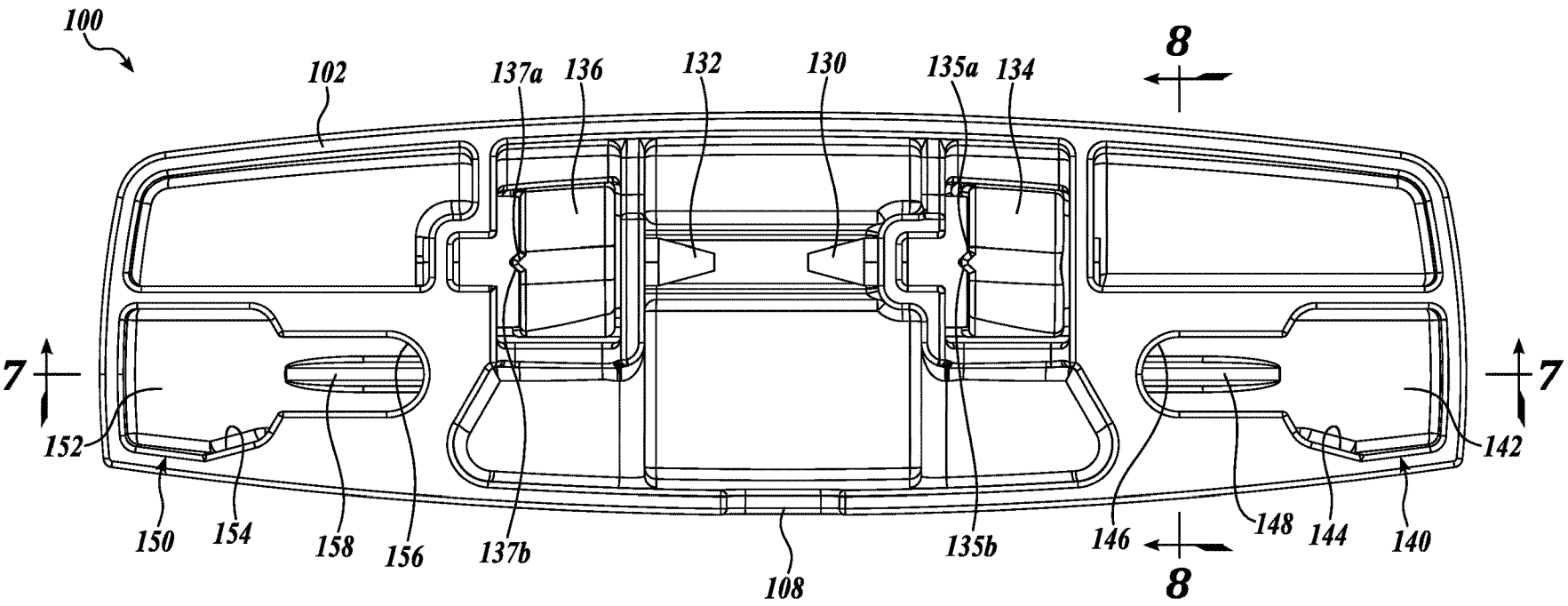

As shown in FIG. 5, the cleat 100 can have a first fastener retention slot 140 and a second fastener retention slot 150 positioned on the bottom of the cleat body 102. This arrangement is intended to conceal the fasteners when the cleat 100 is installed on the mounting surface. In some embodiments, the first and second fastener retention slots 140 and 150 are configured to receive a fastener therein and prevent rotation of the fastener such that a nut can be installed on the threaded shank end without using a tool to hold the fastener head during installation. In the illustrated embodiments, the first and second fastener retention slots 140 and 150 are configured for use with a hex-head bolt; however, other fastener head types can be used, such as square-head bolts.

The first fastener retention slot 140 has an insertion cavity 142 configured to receive the head of the fastener in any rotational configuration, with the shank of the fastener generally aligned perpendicular to a bottom surface of the cleat body 102. In this regard, the hex-head of the fastener does not require rotational alignment prior to inserting the head into the first fastener retention slot 140. The first fastener retention slot 140 further includes an orienting ramp 144 that is configured to rotate the head of the fastener, if needed, from the inserted orientation to an aligned orientation (see, e.g., fastener F of FIG. 6 in the position opposite the insertion cavity 142). The aligned orientation of the fastener permits seating of the fastener into a retaining end 146 that interfaces the head and shank of the fastener to prevent rotation of the fastener, as will be described with reference to FIG. 6, and a top ramp 148 to retain the fastener in an axial translation direction when seated at the retaining end 146. The second fastener retention slot 150 similarly includes an insertion cavity 152, an orienting ramp 154, a retaining end 156, and a top ramp 158. As shown, the insertion cavities 142 and 152 are positioned outwardly from the retention ends 146 and 156, which prevents the cleat 100 from moving longitudinally. These fastener retention slot features will now be explained in further detail with reference to FIGS. 6-8. Although the following description references a fastener interfacing with the first fastener retention slot 140, a similar configuration is intended for the second fastener retention slot 150, with the translation path in the opposite direction (e.g., the paths pointing toward each other and toward the center of the cleat 100).

Figure 3:
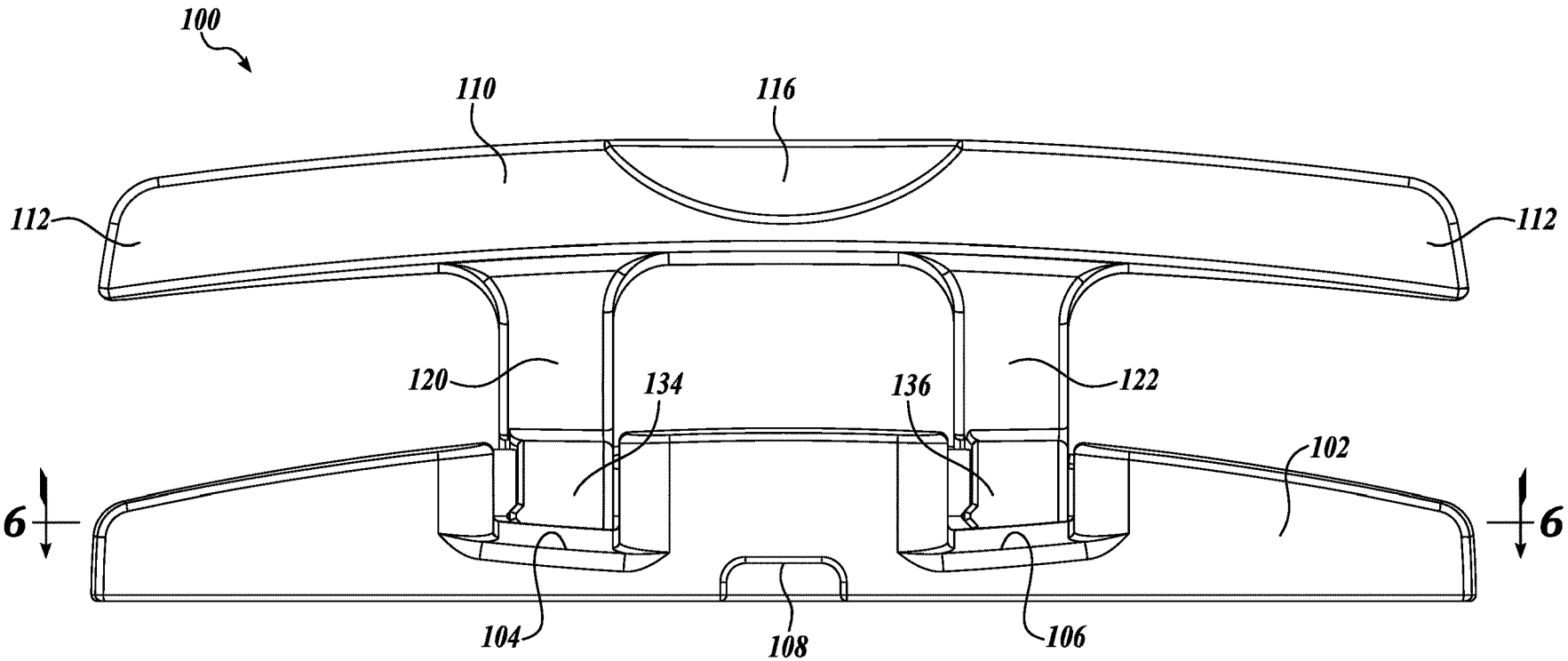
Figure 4:
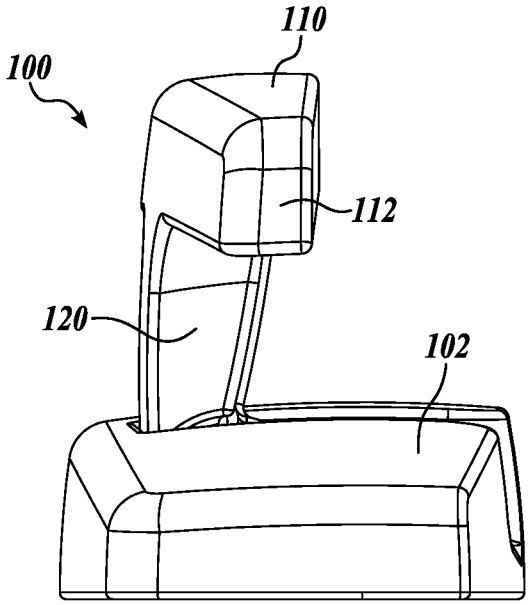
Figure 6:
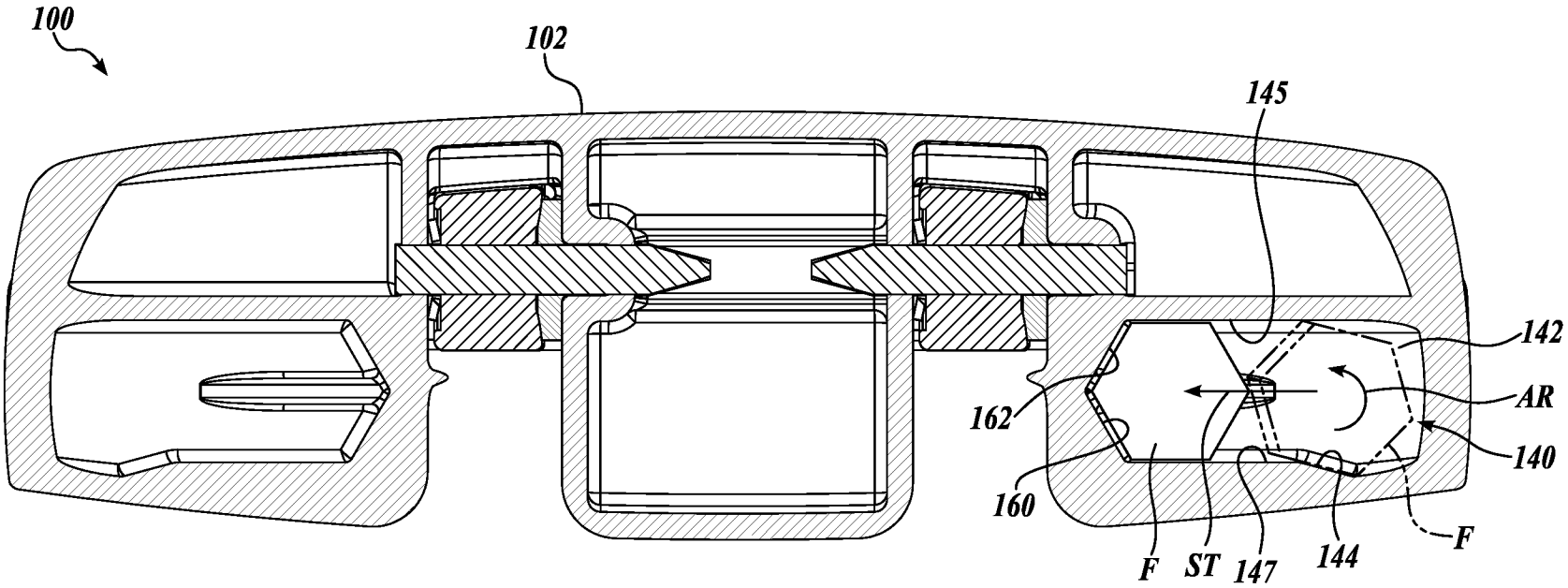
FIG. 6 is a cross-sectional bottom view of the marine cleat of FIG. 1A, taken along the plane 6-6 shown in FIG. 3, showing a fastener being inserted into a retention slot.

FIG. 6 is a cross-sectional bottom view of the cleat 100, taken along the plane 6-6 shown in FIG. 3, and showing a fastener F being inserted into the first fastener retention slot 140. As illustrated, the fastener F can be inserted into the insertion cavity 142 with the hex-head portion of the fastener F in any rotational orientation. For purposes of this description, the rotational orientation of the hex-head portion is intended to represent rotation about the longitudinal axis of the fastener F. Once the fastener F travels toward a seated position at the retaining end 146 (to the left position in the slot 140 as shown in FIG. 6) along the seating translation path ST, the orienting ramp 144 interfaces with one of the flats of the hex-head portion of the fastener F and causes rotation of the fastener F in the direction of the aligning rotation AR. The aligning rotation AR continues until one of the flats of the hex-head of the fastener F generally aligns with a first inner surface 145 of the first fastener retention slot 140, and an opposing flat of the hex-head of the fastener F generally aligns with a second inner surface 147 of the first fastener retention slot 140. Although the orienting ramp 144 is shown as a generally flat surface, in other embodiments, the orienting ramp can be curved or have multiple flat surface segments.

In some embodiments, the first and second inner surfaces 145 and 147 are substantially parallel; however, in other embodiments, the first and second inner surfaces 145 and 147 can be converging to further align the hex-head of the fastener F as it approaches the seated position at the retaining end 146. The first and second inner surfaces 145 and 147 are spaced apart at a distance of at least the distance across the flats of the hex-head of the fastener F. Once the fastener F has traveled along the seating translation path ST and reached the retaining end 146 of the first fastener retention slot 140, one or more of the flats of the hex-head of the fastener F may abut a first seated surface 160 and a second seated surface 162. In this seated position, the surfaces of the first fastener retention slot 140 at the retaining end 146 are at least in close proximity to or abutting four of the six flats on the hex-head of the fastener F (e.g., the first and second inner surfaces 145 and 147 and the first and second seated surfaces 160 and 162). The proximity of at least the first and second inner surfaces 145 and 147 on opposing flats of the hex-head of the fastener F prevents axial rotation of the fastener F during installation of the cleat 100. In this regard, although the first and second seated surfaces 160 and 162 are shown as corresponding to two of the flats of the hex-head, in other embodiments, the surface at the retaining end 146 can be rounded, generally intended to interface with a point of the hex-head, or can be another suitable shape.

Figure 7:
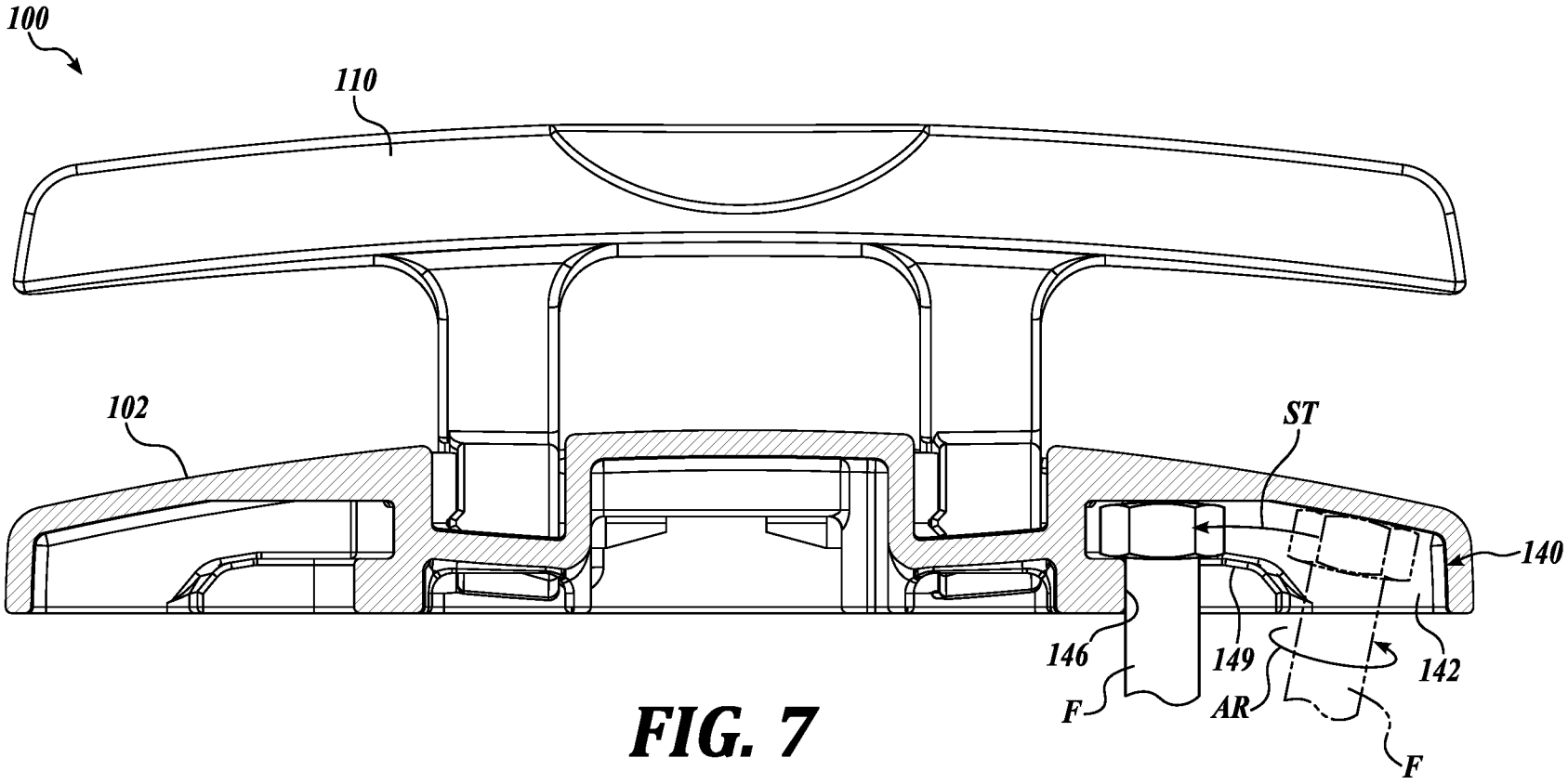
FIG. 7 is a cross-sectional front view of the marine cleat of FIG. 1A, taken along the plane 7-7 shown in FIG. 5, showing the fastener being inserted into the retention slot.

FIG. 7 is a cross-sectional front view of the cleat 100, taken along the plane 7-7 shown in FIG. 5, and showing the fastener F being inserted into the first fastener retention slot 140. As shown, the fastener F can be inserted into the insertion cavity 142 with an axis of the fastener F being rotated with respect to the seated position of the fastener F. In this regard, the seating translation path ST direction can be curved to rotate the fastener F such that the axis of the fastener F is substantially perpendicular to the bottom of the cleat body 102 (see FIG. 7). The first fastener retention slot 140 can have an axial retention surface 149 configured to prevent axial translation of the fastener F in the seated position. In this regard, the axial retention surface 149 can be rounded to improve insertion of the fastener F into the first fastener retention slot 140 toward the seated position. In the seated position at the retaining end 146, the fastener F may be in close proximity or abut the first and second inner surfaces 145 and 147, the first and second seated surfaces 160 and 162, and/or other surfaces of the first fastener retention slot 140.

Figure 8:
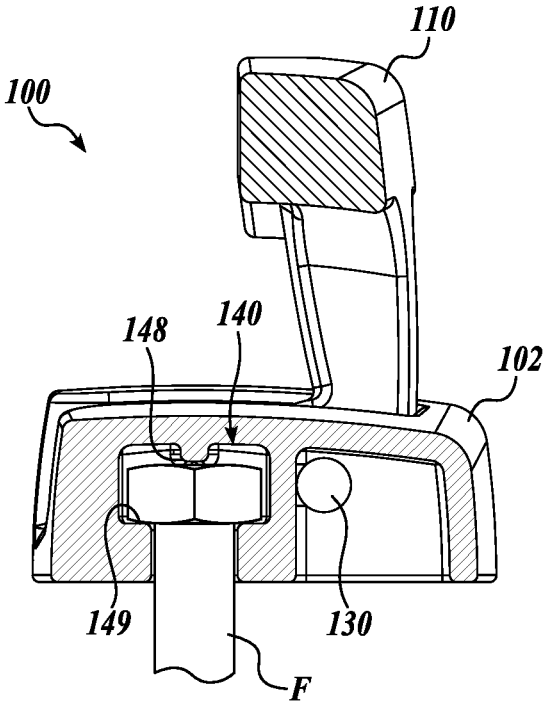
FIG. 8 is a cross-sectional side view of the marine cleat of FIG. 1A, taken along the plane 8-8 shown in FIG. 5, showing the fastener in the retention slot.

FIG. 8 is a cross-sectional side view of the cleat 100, taken along the plane 8-8 shown in FIG. 5, and showing the fastener F being inserted into the first fastener retention slot 140. In some embodiments, as the fastener F is moved along the seating translation path ST, the internal ramp 148 can urge the hex-head of the fastener F toward the axial retention surface 149 to prevent axial translation of the fastener F when in the seated position. In other embodiments, the internal ramp 148 can be omitted such that the fastener F interfaces directly with a surface of the first fastener retention slot 140. The marine cleats described herein can be formed from any suitable material, such as stainless steel, which provides corrosion protection in marine environments; however, other material configurations are also within the scope of the present disclosure.

In the foregoing description, specific details are set forth to provide a thorough understanding of exemplary embodiments of the present disclosure. It will be apparent to one skilled in the art, however, that the embodiments disclosed herein may be practiced without embodying all of the specific details. In some instances, well-known process steps have not been described in detail in order not to unnecessarily obscure various aspects of the present disclosure. Further, it will be appreciated that embodiments of the present disclosure may employ any combination of features described herein.

The present application may reference quantities and numbers. Unless specifically stated, such quantities and numbers are not to be considered restrictive, but exemplary of the possible quantities or numbers associated with the present application. Also in this regard, the present application may use the term "plurality" to reference a quantity or number. In this regard, the term "plurality" is meant to be any number that is more than one, for example, two, three, four, five, etc. The terms "about," "approximately," "near," etc., mean plus or minus 10% of the stated value. For the purposes of the present disclosure, the phrase "at least one of A and B" is equivalent to "A and/or B" or vice versa, namely "A" alone, "B" alone or "A and B". Similarly, the phrase "at least one of A, B, and C," for example, means (A), (B), (C), (A and B), (A and C), (B and C), or (A, B, and C), including all further possible permutations when greater than three elements are listed.

It should be noted that for purposes of this disclosure, terminology such as "upper," "lower," "vertical," "horizontal," "fore," "aft," "inner," "outer," "front," "rear," etc., should be construed as descriptive and not limiting the scope of the claimed subject matter. Further, the use of "including," "comprising," or "having" and variations thereof herein is meant to encompass the items listed thereafter and equivalents thereof as well as additional items. Unless limited otherwise, the terms "connected," "coupled," and "mounted" and variations thereof herein are used broadly and encompass direct and indirect connections, couplings, and mountings.

Throughout this specification, terms of art may be used. These terms are to take on their ordinary meaning in the art from which they come, unless specifically defined herein or the context of their use would clearly suggest otherwise.

The principles, representative embodiments, and modes of operation of the present disclosure have been described in the foregoing description. However, aspects of the present disclosure, which are intended to be protected, are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure as claimed.

The embodiments of the invention in which an exclusive property or privilege is claimed are defined as follows:

1. A marine cleat for securing a line to a structure, the marine cleat comprising:

a cleat body configured to operably couple to a mounting surface of the structure, the cleat body comprising:

a top side including a cleat head extending away from the top side and having a first projection and a second projection extending in opposite directions along the mounting surface, the cleat head being configured to receive a portion of the line; and a bottom side having a first fastener retention slot and a second fastener retention slot, the first and second fastener retention slots each having:

an insertion cavity that is configured to receive a head of a fastener therein; and a retention end that is configured to laterally receive the head of the fastener and fix the fastener in both axial translation and axial rotation with respect to the cleat body, wherein the insertion cavities of the first and second fastener retention slots are positioned outwardly from the retention ends.

2. The marine cleat of claim 1, wherein the first and second retention slots each further comprise opposing first and second inner surfaces spaced apart at a distance configured to interface with the head of the fastener to prevent axial rotation of the fastener.

3. The marine cleat of claim 2, wherein first and second fastener retention slots each further comprise an axial retention surface at the retention end, wherein the axial retention surface is configured to interface with the head of the fastener to prevent axial translation of the fastener.

4. The marine cleat of claim 3, wherein the first and second fastener retention slots each further comprise an internal ramp configured to interface with the head of the fastener and urge the head of the fastener toward the axial retention surface at the retention end.

5. The marine cleat of claim 2, wherein the first and second fastener retention slots each further comprise an orienting ramp positioned between the insertion cavity and the retention end, wherein the orienting ramp is configured to interface the head of the fastener and axially rotate the fastener such that the head aligns with at least one of the first and second inner surfaces.

6. The marine cleat of claim 1, wherein the cleat body is elongated and wherein the first and second projections are longitudinally oriented with respect to the cleat body.

7. The marine cleat of claim 1, wherein the cleat body is elongated and wherein the cleat head is laterally foldable by rotating with respect to the cleat body.

8. The marine cleat of claim 7, wherein the cleat head is operably coupled to the cleat body by a first leg and a second leg, wherein the cleat body further comprises a first clearance trough and a second clearance trough, and wherein the first leg is received within the first clearance trough and the second leg is received within the second clearance trough when the cleat head is in a stowed position with respect to the cleat body.

9. The marine cleat of claim 7, wherein the cleat body further comprises:

a first detent configured to resist rotation of the cleat head from a stowed position to a deployed position; and a second detent configured to resist rotation of the cleat head from the deployed position to the stowed position.

10. The marine cleat of claim 7, wherein the cleat head further comprises an opening relief configured to receive a finger of a user to assist in rotating the cleat head with respect to the cleat body from a stowed position.

11. The marine cleat of claim 1, wherein the cleat body further comprises a drain opening to permit water flow away from the bottom side of the cleat body.

12. A folding marine cleat for securing a line to watercraft, the marine cleat comprising:

a cleat body configured to operably couple to a mounting surface of the watercraft, the cleat body having a first fastener retention slot and a second fastener retention slot, the first and second fastener retention slots each having:

an insertion cavity that is configured to receive a head of a fastener therein; and a retention end that is configured to laterally receive the head of the fastener and fix the fastener in both axial translation and axial rotation with respect to the cleat body; and a cleat head rotationally coupled to the cleat body and movable between a stowed position and a deployed position, the cleat head having a first projection and a second projection extending in opposite directions along the mounting surface and configured to receive a portion of the line.

13. The folding marine cleat of claim 12, wherein the insertion cavities of the first and second fastener retention slots are positioned outwardly from the retention ends.

14. The folding marine cleat of claim 12, wherein the first fastener retention slot has a first translation path for a first fastener head traveling from the insertion cavity to the retention end, wherein the second fastener retention slot has a second translation path for a second fastener head traveling from the insertion cavity to the retention end, and wherein the first and second translation paths point toward each other.

15. The folding marine cleat of claim 14, wherein the first and second translation paths are parallel.

16. The folding marine cleat of claim 12, wherein the first and second retention slots each further comprise opposing first and second inner surfaces spaced apart at a distance configured to interface with the head of the fastener to prevent axial rotation of the fastener.

17. The folding marine cleat of claim 16, wherein first and second fastener retention slots each further comprise an axial retention surface at the retention end, wherein the axial retention surface is configured to interface with the head of the fastener to prevent axial translation of the fastener.

18. The folding marine cleat of claim 16, wherein the first and second fastener retention slots each further comprise an orienting ramp positioned between the insertion cavity and the retention end, wherein the orienting ramp is configured to interface the head of the fastener and axially rotate the fastener such that the head aligns with at least one of the first and second inner surfaces.

19. The folding marine cleat of claim 12, wherein the cleat body is elongated and wherein the first and second projections are longitudinally oriented with respect to the cleat body.

20. The folding marine cleat of claim 12, wherein the cleat head is operably coupled to the cleat body by a first leg and a second leg, wherein the cleat body further comprises a first clearance trough and a second clearance trough, and wherein the first leg is received within the first clearance trough and the second leg is received within the second clearance trough when the cleat head is in the stowed position.

* * * * *